US007942790B2

(12) United States Patent
Papadopoulos

(10) Patent No.: US 7,942,790 B2
(45) Date of Patent: May 17, 2011

(54) ROLLER TRAINER ASSEMBLY WITH SAFEGUARDS

(76) Inventor: Larry C. Papadopoulos, North Plains, OR (US)

( * ) Notice: Subject to any disclaimer, the term of this patent is extended or adjusted under 35 U.S.C. 154(b) by 0 days.

(21) Appl. No.: 12/456,728

(22) Filed: Jun. 22, 2009

(65) Prior Publication Data

US 2009/0264261 A1 Oct. 22, 2009

(51) Int. Cl.
*A63B 69/16* (2006.01)

(52) U.S. Cl. ..... 482/61; D21/664

(58) Field of Classification Search ..... 482/51, 482/54, 57, 61, 93, 58, 59, 60, 62, 63; D21/663, D21/664, 669

See application file for complete search history.

(56) References Cited

U.S. PATENT DOCUMENTS

| | | | | |
|---|---|---|---|---|
| 2,498,047 | A * | 2/1950 | Myers | 601/93 |
| 6,500,098 | B1 * | 12/2002 | Werner | 482/57 |
| 7,220,219 | B2 * | 5/2007 | Papadopoulos et al. | 482/57 |
| 2004/0077465 | A1 * | 4/2004 | Schmidt | 482/57 |

* cited by examiner

*Primary Examiner* — Loan Thanh
*Assistant Examiner* — Tam Nguyen
(74) *Attorney, Agent, or Firm* — Timothy E Siegel Patent Law, PLLC

(57) ABSTRACT

Bicycle rollers that include a frame and front and rear rollers mounted in the frame, each having two lateral ends. Also, a pair of bumper/rollers are mounted on the frame adjacent both sides of the front roller. They are mounted so as to be horizontally rotatable, thereby acting to constrain a wheel of a bicycle supported by the front roller from moving laterally off the roller, while not stopping rotation of the bicycle wheel.

7 Claims, 3 Drawing Sheets

ROLLER TRAINER ASSEMBLY WITH SAFEGUARDS

RELATED APPLICATIONS

This application claims priority from patent application Ser. No. 11/520,288 filed Sep. 13, 2006, which claimed priority from provisional application Ser. No. 60/716,852 filed Sep. 14, 2005.

BACKGROUND

A bicycle training device known as "bicycle rollers" has been available for over one hundred years. This device consists of three rollers supported by a frame. In use, the rear wheel of a bicycle is brought to rest on two, relatively closely spaced (by about 20 cm) bracketing rollers and the front wheel is balanced on top of the third roller. This device permits a user to balance and steer the bicycle (within a range) and to pedal at any speed desired. Unfortunately, users are constrained as to how aggressively they can exercise since rapid changes in pedaling speed and rider position can easily cause the rear wheel to pop out of its bracketing rollers. Additionally, a bicycle which is rigidly constrained acts to discourage the rider's natural movement and is somewhat uncomfortable to ride. It is a principle object of this invention to provide an additional degree of motion to more closely duplicate the natural feel of outdoor cycling.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

In a first separate aspect, the present invention may take the form of bicycle rollers that include a frame and front and rear rollers mounted in the frame, each having two lateral ends. Also, a pair of bumper/rollers are mounted on the frame adjacent both sides of the front roller. They are mounted so as to be horizontally rotatable, thereby acting to constrain a wheel of a bicycle supported by the front roller from moving laterally off the roller, while not stopping rotation of the bicycle wheel.

In a second separate aspect, the present invention may take the form of bicycle rollers that include a frame and front and rear rollers mounted in the frame. Also, a front rotatable bumper/roller is mounted on the frame, in front of and above the front roller. The front rotatable bumper/roller acts to constrain a bicycle wheel that has moved for or aft from its intended position, without braking the rotation of the bicycle wheel.

In addition to the exemplary aspects and embodiments described above, further aspects and embodiments will become apparent by reference to the drawings and by study of the following detailed descriptions.

BRIEF DESCRIPTION OF THE DRAWINGS

Exemplary embodiments are illustrated in referenced figures of the drawings. It is intended that the embodiments and figures disclosed herein are to be considered illustrative rather than restrictive.

DETAILED DESCRIPTION OF THE PREFERRED EMBODIMENTS

Figure 1:
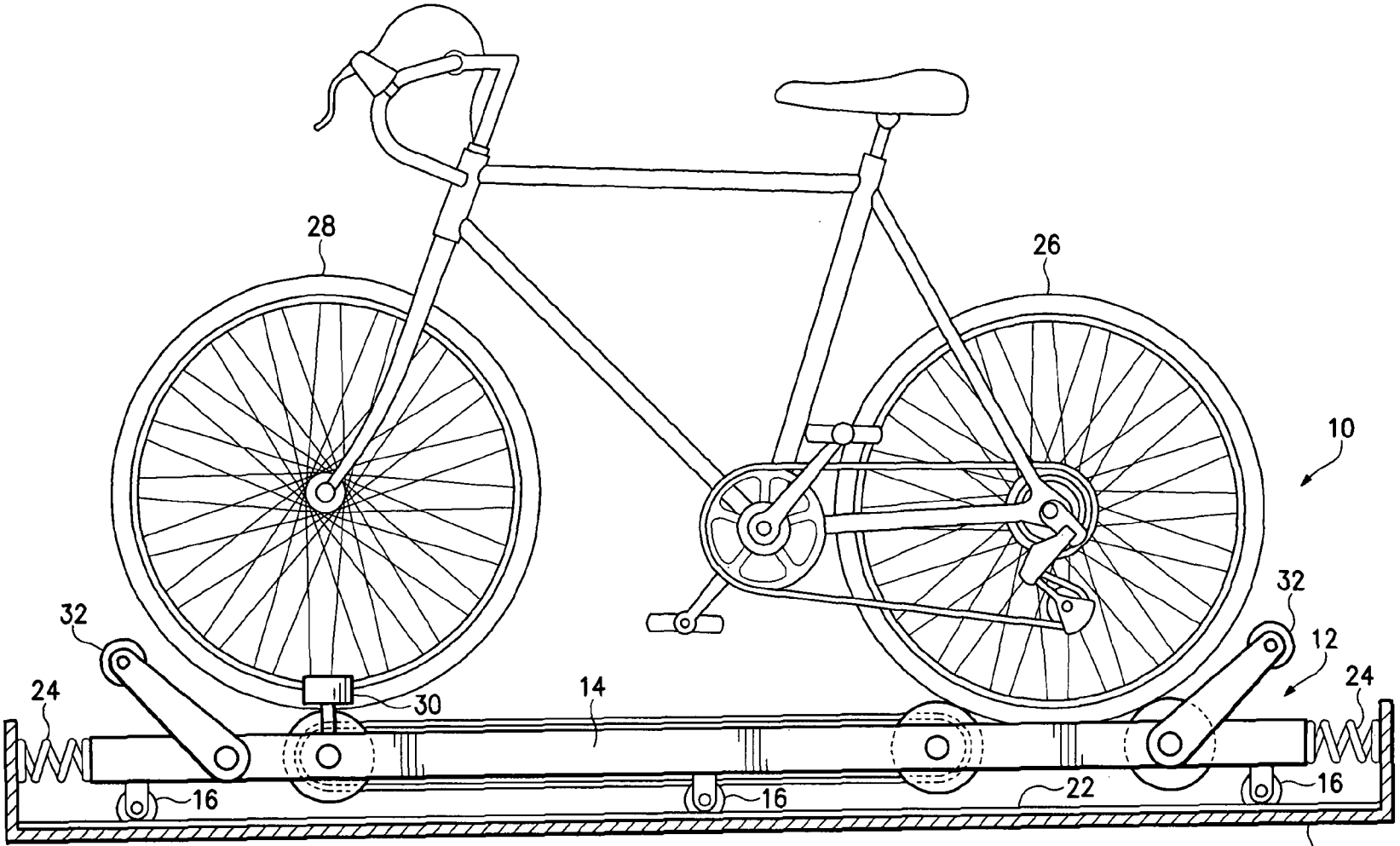
FIG. 1 is a side view of a bicycle training assembly according to a preferred alternative embodiment of the present invention.
Figure 1A:
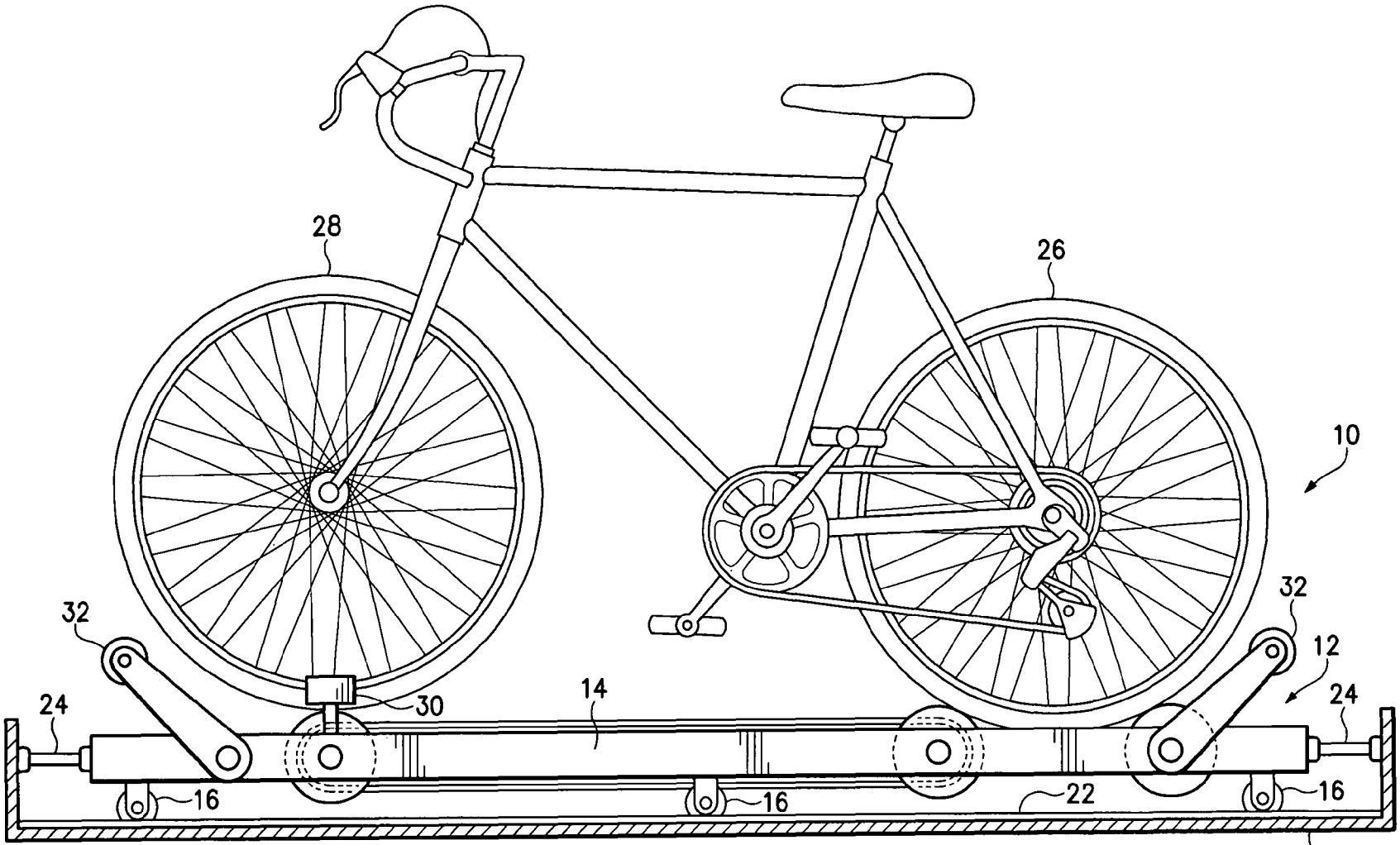
FIG. 1A is a side view of the bicycle training assembly of FIG. 1, but with bungees serving as the springs.
Figure 2:
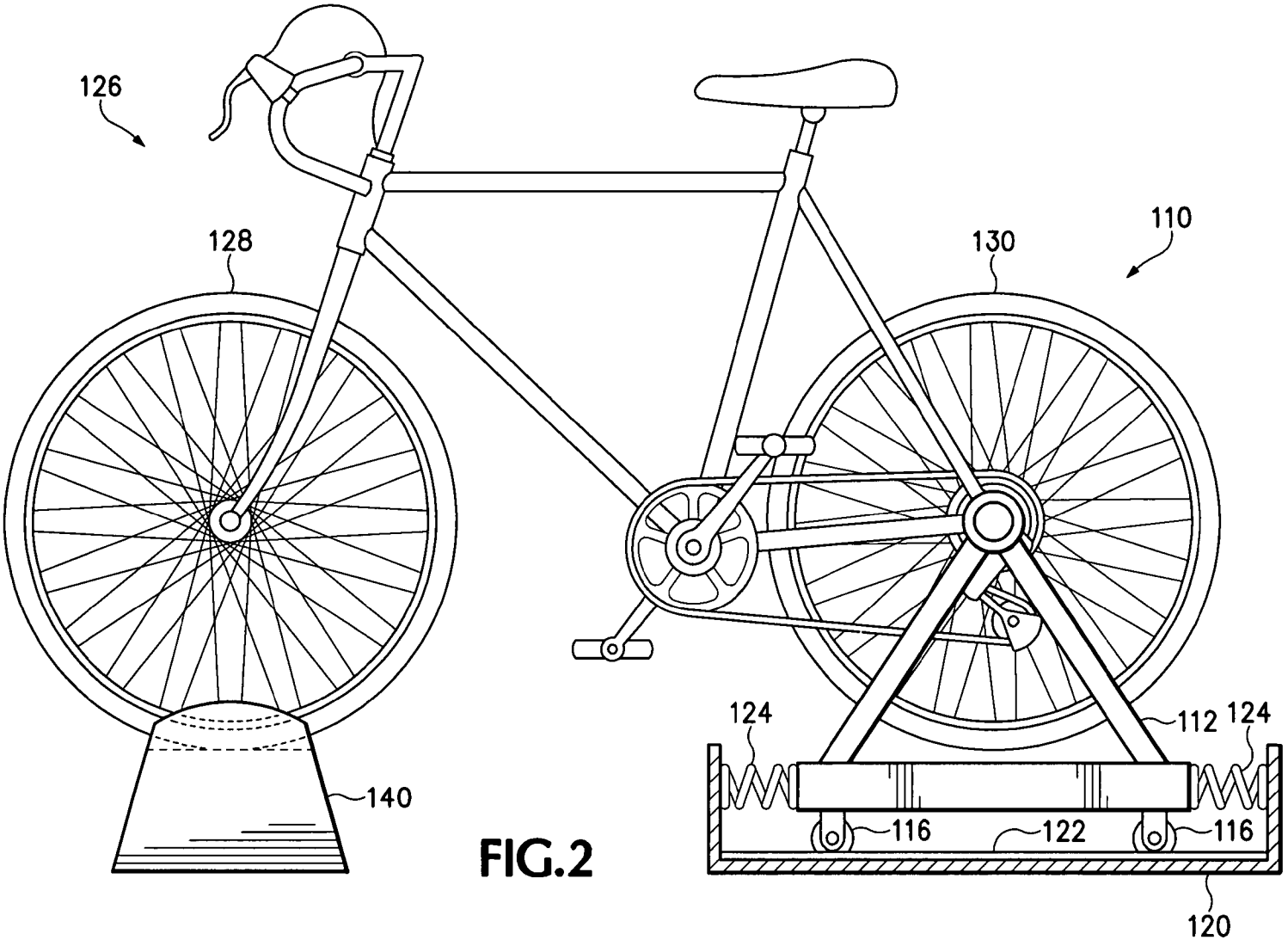
FIG. 2 is side view of a bicycle training assembly according to an alternative preferred embodiment of the present invention.

Referring to FIG. 1, a training assembly 10, includes a set of bicycle rollers 12 having a rollers frame 14, which is supported by wheels 16. In turn rollers 12 are constrained by an assembly frame 20, which also provides a pair of tracks 22 (only one shown) for wheels 16, thereby permitting relative motion between the rollers 12 and the assembly frame 20. Additionally, a light spring device 24 acts to gently return the rollers (and bicycle rider) to the center of the stroke whenever the rider's actions generate a plus or minus motion, thereby permitting equal amounts of forward and rearward motion from a central point. Preferably, a vibration damping spring, such as an elastomeric linear element (bungee) is used for spring 24 (as shown in FIG. 1A).

In an alternative preferred embodiment a stationary exercise bicycle is mounted so that fore and aft movement relative to a supporting surface is permitted during use. In the context of this application the term "bicycle-utilizing bicycle trainer" is any device into which an actual bicycle is placed, prior to use. This includes both bicycle rollers and plain or basic trainers, but not exercise bicycles.

Providing a frame 20 into which the bicycle training device, such as bicycle rollers 12 is set, provides a smooth, hard surface for wheels 16 to rotate and permits the tethering of a spring that gently moves rollers 12 back to the center of frame 20 when the bicycle rider's motion has pulled rollers 12 fore or aft. In an alternative preferred embodiment, however, frame 20 is not present and bicycle rollers 12, equipped with wheels 16, is set onto a hard smooth surface, such as a concrete or cement surface. If wheels 16 are made of polymeric material, rollers 12 can even be set onto a wooden floor without damaging the floor. In addition, wheels 16 may be adapted for their intended use. For example, pneumatic tires can be used for use of rollers 12 on an asphalt surface. Although in this embodiment springs are not present to return rollers 12 to their starting position, in practice there is not a great deal of movement and a paved area that is only slightly larger than rollers 12 can accommodate a bicycle rider training on the wheeled rollers 12.

The front wheel 28 of the bicycle mounted on rollers 12 is prevented from slipping off rollers 12 by a pair of horizontally mounted rollers 30. Because they are rotatable, rollers 30 constrain front wheel 28 without stopping its rotation, which could cause an accident, potentially injuring the bicycle rider. Likewise for and aft rotatable roller/bumpers 32 prevent further movement when front and rear bicycle wheels 28 and 26 move fore or aft from the intended position on rollers 12. Roller/bumpers 32 act to gently return wheels 28 and 26 to their intended position.

In alternative preferred embodiments, wheels 16 are replaced by some other relative motion permitting assembly adapted to permit for and aft motion between the rider and the surface upon which assembly 10 or other similar assembly is resting. These preferred embodiments include the case in which frame 20 is not provided and wheels 16 rest on some available surface such as a floor or a patio. In this embodiment wheels 16 may be enlarged and/or fitted with pneumatic tires. Other embodiments include cases in which the relative motion permitting assembly includes a frame, such as frame 20, but where wheels 16 are mounted upwardly on frame 20 rather than downwardly on trainer device 12. Alternatively, sliding surfaces on 20 and 12 could provide relative motion, or ball bearings, possibly in races, could provide the relative motion between a frame, such as frame 20 and a trainer device, such as trainer device 12.

In an alternative preferred embodiment of a training assembly 110, a basic trainer 112 is placed on wheels 116 and set into a frame 120 to travel on tracks 122 and is returned to center by springs 124. Trainer 112 keeps bicycle 126 laterally upright and provides resistance to rear wheel 130. A stool 140 is provided for front wheel 128, which does not rotate and will translate in the same constrained manner as rear wheel 130.

While a number of exemplary aspects and embodiments have been discussed above, those possessed of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

The invention claimed is:

1. A bicycle roller assembly, comprising:

(a) a frame;

(b) a front roller mounted in said frame and having two lateral ends;

(c) a pair of rear rollers mounted in said frame;

(d) said front roller and rear rollers being together adapted to receive a bicycle having a front wheel and a rear wheel, with said front wheel supported by said front roller and said rear wheel supported by said rear rollers; and (e) a pair of bumper rollers mounted on said frame adjacent said lateral ends of said front roller and mounted so as to be horizontally rotatable, thereby acting to constrain said front wheel of said bicycle supported by said front roller from moving laterally off said roller, by directly contacting said front wheel, while not stopping rotation of said front bicycle wheel.

2. The bicycle roller assembly of claim 1, further including a relative motion-permitting device interposed between said frame and a supporting surface, and permitting relative front and rear movement of said frame relative to said supporting surface, while said assembly is in use.

3. The bicycle roller assembly of claim 2, in which said relative motion-permitting device includes a set of wheels attached to said frame, said wheels permitting relative motion between said frame and said supporting surface while said bicycle roller assembly is in use.

4. A bicycle roller assembly, comprising:

(a) a frame;

(b) a front roller mounted in said frame;

(c) a pair of rear rollers mounted in said frame;

(d) a bicycle, having a front wheel and a rear wheel, mounted on said rollers by having said front wheel balanced on said front roller and said rear wheel supported by said pair of rear rollers; and (e) a front rotatable bumper roller mounted on said frame, in front of and above said front roller wherein said front rotatable bumper roller constrains said front wheel when it moves forward from its intended position on said front roller, without braking the rotation of said bicycle front wheel.

5. The bicycle roller assembly of claim 4, further including a rear rotatable bumper roller mounted on said frame, behind and above said pair of rear rollers and acting to constrain said rear wheel that has moved rearward from its intended position on said rear rollers, without braking the rotation of said rear wheel.

6. The bicycle roller assembly of claim 4, further including a relative motion permitting device interposed between said frame and a supporting surface, and permitting relative front and rear movement of said frame relative to said supporting surface.

7. The bicycle roller assembly of claim 6, in which said relative motion-permitting device includes a set of wheels attached to said frame, said wheels permitting relative motion between said frame and said supporting surface while said bicycle roller assembly is in use.

* * * * *

UNITED STATES PATENT AND TRADEMARK OFFICE

CERTIFICATE OF CORRECTION

PATENT NO. : 7,942,790 B2
APPLICATION NO. : 12/456728
DATED : May 17, 2011
INVENTOR(S) : Larry C. Papadopolous It is certified that error appears in the above-identified patent and that said Letters Patent is hereby corrected as shown below:

On the Title page, Item (62) and (60) entitled Related U.S. Application Data should be included with the following information:
(62) Continuation of application No. 11/520,288 filed on September 13, 2006, now Pat. No. 7,604,575.
(60) Provisional application No. 60/716,852 filed on September 14, 2005.

In the Specification

Under Related Applications, column 1, line 6, the text "claims priority from" should be deleted and should be replaced with --is a continuation of--.

Under Related Applications, column 1, line 7, after "2006," insert --now U.S. Pat. No. 7,604,575,--.

Signed and Sealed this
Second Day of September, 2014

Michelle K. Lee

Michelle K. Lee
*Deputy Director of the United States Patent and Trademark Office*